US005127284A

United States Patent [19]

Jorgensen

[11] Patent Number: 5,127,284

[45] Date of Patent: Jul. 7, 1992

[54] SETTING APPARATUS

[75] Inventor: Geert Jørgensen, Nordborg, Denmark

[73] Assignee: Danfoss A/S

[21] Appl. No.: 594,663

[22] Filed: Oct. 9, 1990

Related U.S. Application Data

[63] Continuation of Ser. No. 377,108, Jul. 10, 1989, abandoned.

[30] Foreign Application Priority Data

Jul. 12, 1988 [DE] Fed. Rep. of Germany ..... 3823537

[51] Int. Cl.[5] ..... G05G 1/04; G05G 9/00

[52] U.S. Cl. ..... 74/523; 74/504; 74/471 XY

[58] Field of Search ..... 74/538, 504, 553, 511 R, 74/503, 10.22, 10 R, 526, 471 XY; 200/336, 316, 308, 314, 6 A, 6; 116/DIG. 28; 192/95, 108

[56] References Cited

U.S. PATENT DOCUMENTS

| | | | |
|---|---|---|---|
| 2,590,263 | 3/1952 | Mead et al. | 74/553 X |
| 2,674,133 | 4/1954 | Ireland | 74/553 X |
| 2,863,968 | 12/1958 | Trautman | 74/553 X |
| 3,018,671 | 1/1962 | Ogle et al. | 74/504 |
| 3,080,185 | 3/1963 | Walker | 74/504 X |
| 3,512,427 | 5/1970 | Metcalf | 74/504 X |
| 3,986,409 | 10/1976 | Tripp et al. | 192/95 X |
| 4,131,033 | 12/1978 | Wright et al. | 74/504 X |
| 4,153,149 | 5/1979 | Weber | 74/553 X |
| 4,355,544 | 10/1982 | Post | 74/526 |
| 4,450,856 | 5/1984 | Kocher | 74/553 X |
| 4,849,583 | 7/1989 | Meyer | 200/6 A |

FOREIGN PATENT DOCUMENTS

| | | | |
|---|---|---|---|
| 2205415 | 8/1973 | Fed. Rep. of Germany | 74/504 |
| 3823537 | 10/1989 | Fed. Rep. of Germany | 74/473 R |
| 8102257 | 12/1982 | Netherlands | 74/553 |

*Primary Examiner*—Vinh T. Luong

[57] ABSTRACT

The setting apparatus includes a housing having an operating grip mounted thereon for pivotal movement about a first axis between a neutral position and a second position for adjusting a signal changing device. An abutment member is mounted by the housing to pivot about an axis extending perpendicular to the first axis and has a face in abutting relationship to the face of a pressure face member. A rod and a spring are mounted by the operating grip for longitudinal movement and rotary movement relative to the grip to retain the pressure member face in abutting relationship to the abutment member face for selectively adjusting the neutral position of the operating grip upon rotation of the rod and resiliently urging the operating grip to its neutral position when the operating grip is moved out of its various selected adjusted neutral positions. The pressure member face is inclined relative to the axis of rotary movement of the rod and when the rod is rotated, pivots the abutment member relative to the housing and the pressure face. The signal device includes a first part attached to the operating grip pivot to pivot as the operating grip is pivoted and a second part mounted by the housing in engagement with the first part.

16 Claims, 2 Drawing Sheets

FIG. 3a
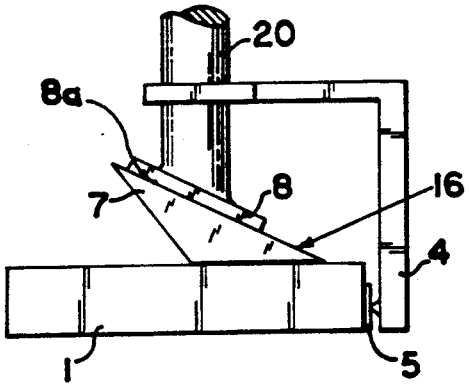
FIG. 3b
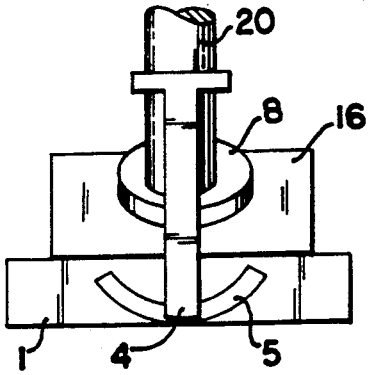
FIG. 4a
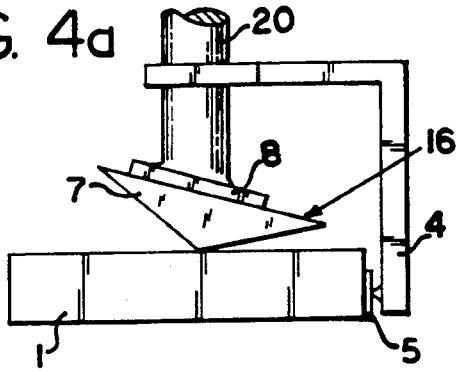
FIG. 4b
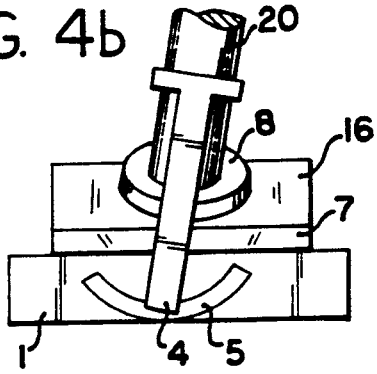
FIG. 5a
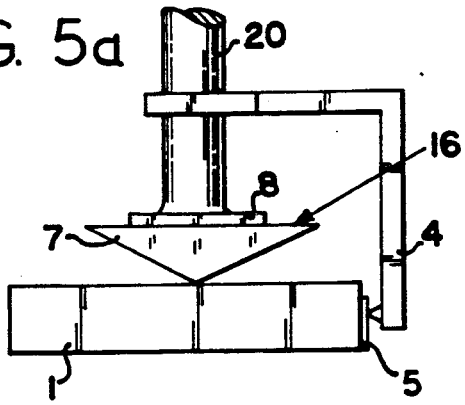
FIG. 5b
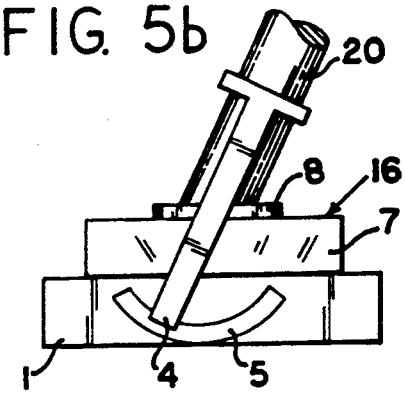
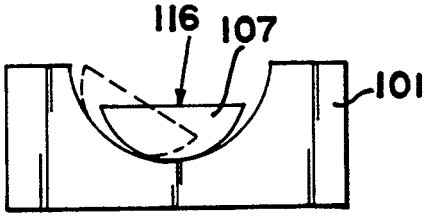
FIG. 6

SETTING APPARATUS

RELATED APPLICATION

This application is a continuation of application Ser. No. 07/377,108, filed on July 10, 1989 (now abandoned).

FIELD OF THE INVENTION

The invention relates to a setting apparatus comprising a housing, an operating grip pivotable on the housing about a pivot axis, a lever arm, a centering device and a signal changing device.

DESCRIPTION OF THE PRIOR ART

Such a setting apparatus is known from the Applicants' brochure "Remote Control Unit PVRES" (Spare Parts Brochure HN.50.N1.52 dated Dec. 1986). According to this, an operating grip can be moved linearly in two directions, i.e. reciprocated. This adjusts a signal changing device, in this case a potentiometer, it being possible to actuate a microswitch simultaneously. This setting apparatus automatically returns to its neutral position after actuation of the lever, the neutral position being located substantially centrally between the two end positions of the operating grip. The setting apparatus cannot be fixed in a different intermediate position.

U.S. Pat. No. 25 53 280, to Rossire, issued Sep. 30, 1948, discloses a setting apparatus for an autopilot, wherein an operating grip is movable in several directions. After each movement, the grip is held by friction in the position it has taken up, i.e. there is no neutral position into which the grip returns automatically when it is released.

SUMMARY OF THE INVENTION

It is the problem of the present invention to provide a setting apparatus which is adjustable in two directions, returns to its neutral position without external force effects and has an adjustable neutral position.

This problem is solved in a setting apparatus of the aforementioned kind in that the centering device comprises a pressure face on either the housing or operating grip, which face, under the force of a spring acting along the longitudinal axis of the shank of the grip, is pressed against an abutment on either the operating grip or housing, respectively, the abutment and/or pressure face being adjustable with respect to the intergers on which they are provided.

This provides a setting apparatus of which the operating grip can be reciprocated and returns to its neutral position after being released, this neutral position being adjustable.

The spring in the setting apparatus always seeks to assume a position at which it has stored the minimum energy. A compression spring will always seek to expand and a tension spring to contract. The neutral position of the operating grip is in all possible positions that in which the spring has stored the least energy. The length of the spring and thus the energy stored is in each position determined by the relative position of the pressure face of the pressure face member and abutment. When the two parts are in contact, the stored spring energy is a minimum. By adjusting the pressure face member and/or abutment, it is possible to change the angular position of the operating grip in which the spring has the least energy. The neutral position of the operating grip is thereby automatically adjusted with it.

According to the invention, the setting apparatus can therefore be permanently held in a position selected at will. The setting apparatus can be moved out of the selected neutral position to influence signals.

In a preferred embodiment, the pressure face is inclined relatively to the longitudinal axis of the lever arm shank (operating grip) about an angle of inclination which is adjustable in the plane of movement of the operating grip. Generally, the spring presses the pressure face flat against the abutment in the neutral position. By inclining the pressure face relatively to the operating grip, i.e. when the pressure face assumes an angle relatively to the longitudinal axis of the operating grip, the operating grip will be inclined to the perpendicular when the pressure face lies flat against the abutment. By adjusting the angle, one can in a simple manner set the inclination of the operating grip in the neutral position.

Advantageously, the pressure face member is fixed to rotate with a rod disposed parallel to the longitudinal axis of the operating grip, the rod and pressure face forming a constant angle and the rod being rotatable about its longitudinal axis. This permits the angle enclosed between the pressure face in the plane of movement of the operating grip and the longitudinal axis of the lever arm to be adjusted about this longitudinal axis simply by turning the pressure face member.

In a preferred embodiment, the operating grip is mounted on two bearing points disposed on the pivot axis. The pressure member face and the abutment are disposed between the two planes extending through the bearing points and perpendicular to the pivot axis. The force of the spring of the centering device causes a permanent torque to be exerted on the bearing points. If the bearing points are disposed on both sides of the centering device, the torque load on the bearing is very considerably reduced.

In a further advantageous embodiment, the operating grip is substantially Y-shaped in a cross-section in a plane perpendicular to the pivot axis of a shaft that mounts the operating grip for pivotal movement about said axis and is mounted by a housing, the arm being fixed to the shaft to rotate with the shaft. The operating grip can therefore be bifurcated, the two bifurcations being secured to the shaft, or pot-shaped and being of a substantially circumferentially closed configuration. Of course in this case one must ensure that the circumferential edge of the pot facing the housing will not impede movement of the operating grip.

Preferably, the rod is mounted in the shank of the operating grip and axially displaceable against the force of the spring, the pressure face member being arranged at the end of the rod adjacent to the housing. Thus, the rod is guided by the operating grip and is movable to stress the spring. The force of the spring causes the rod and thus the pressure face to be pressed against the abutment.

With advantage, the rod forms a guide for the spring. This ensures that the spring cannot deflect laterally when loaded.

In a particularly preferred embodiment, the abutment comprises an abutment body with an abutment face, the abutment body being pivoted to the housing about an axis extending perpendicular to the pivot axis of the operating grip. Expecially when the pressure face is turned about its longitudinal axis by rotating the rod so as to alter the angle between the pressure face and longitudinal axis of the lever arm in the plane of movement, the pressure face will always be pressed flatly against an abutment face. The pressure face therefore always has a defined abutment.

In a preferred embodiment, the abutment body has a triangular cross-section. A triangle is easy to tilt.

Advantageously, the abutment body is rotatably secured to the housing by its tip apex portion lying against the housing. This can be achieved very simply in that the tip of a triangular shaped body is mounted to a shaft which is secured to the housing at one or more bearing points.

In another preferred embodiment, the cross-section of the abutment body has the shape of a segment of a circle and is mounted in a trough in the housing. The abutment body is thus formed by the segment of a cylinder. The abutment body can be displaced within the trough, different positions resulting in different inclinations of the abutment face of the abutment member.

In a preferred embodiment, the rod projects from the operating grip and is connected to a rotary knob. This increases the operating comfort because the user can change the angular position of the pressure face in the plane of movement of the operating grip simply by turning the rotary knob.

Advantageously, the rotary knob and the adjoining part of the operating grip are provided with markings. This enables neutral positions of the setting apparatus to be precisely reproduced repeatedly. The operator need only set the rotary knob to the previously determined marking to ensure that the operating grip is then fixed in the desired neutral position.

In a futher preferred embodiment, a rod extends into the shank of the operating grip and is axially movable relative to the shank. A pressure body has a pressure face and is fixed to the rod and is rotatable therewith. The force of the spring is transmitted to the pressure face body in order that the pressure face is pressed towards the abutment. With this feature, the setting apparatus is of a modular construction whereby the pressure face which can become worn through frequent adjustments is easily replaceable.

With advantage, one part of a signal changing device is fixed to the shaft to be rotated therewith while a second part of the device is mounted by the housing. Moving the operating grip in one of two directions, the shaft is moved to move the device of said one part relative to the second part.

A preferred example of the invention will now be described in conjunction with the drawing wherein:

BRIEF DESCRIPTION OF THE DRAWINGS

FIG. 3*a* is a diagrammatic front elevation of the setting apparatus with the neutral position in the middle, i.e. with a 0° angle of rotation of the rotary knob, FIG. 3*b* is a side elevation of the FIG. 3*a* position, FIG. 4*a* is a front elevation of the setting apparatus with a different angle for the pressure face, FIG. 4*b* is a side elevation of the setting apparatus according to FIG. 4*a*, FIG. 5*a* is a front elevation of the setting apparatus with the other extreme angular setting of the pressure face, i.e. 90° angle of rotation of the rotary knob, FIG. 5*b* is a side elevation of the setting apparatus according to FIG. 5*a* with an extreme neutral position, and FIG. 6 is a further embodiment of the abutment body mounted in the housing.

DESCRIPTION OF THE PREFERRED EMBODIMENTS

Figure 1:
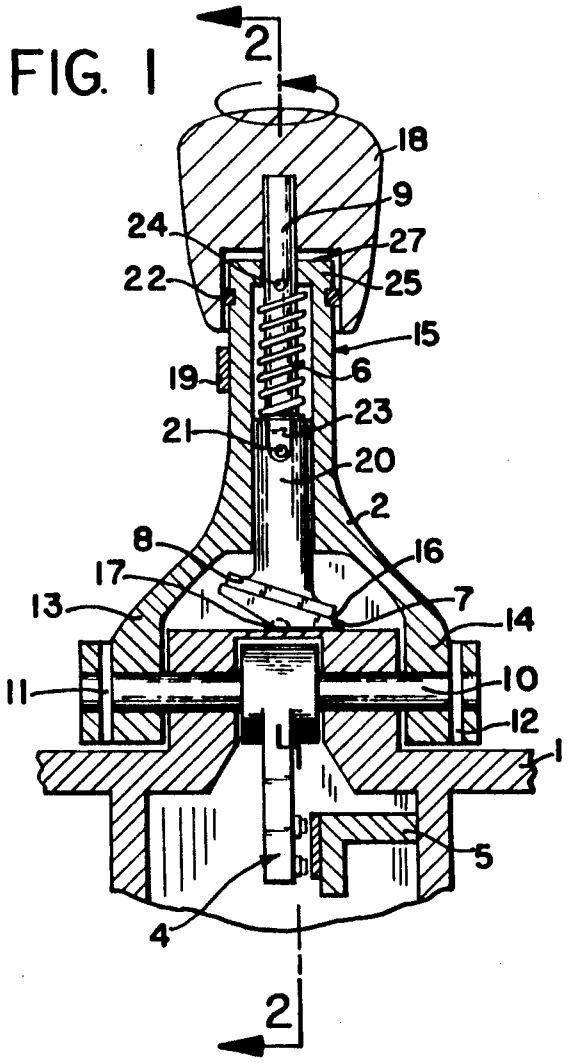
FIG. 1 is a section 1—1 taken in FIG. 2 of the setting apparatus.
Figure 2:
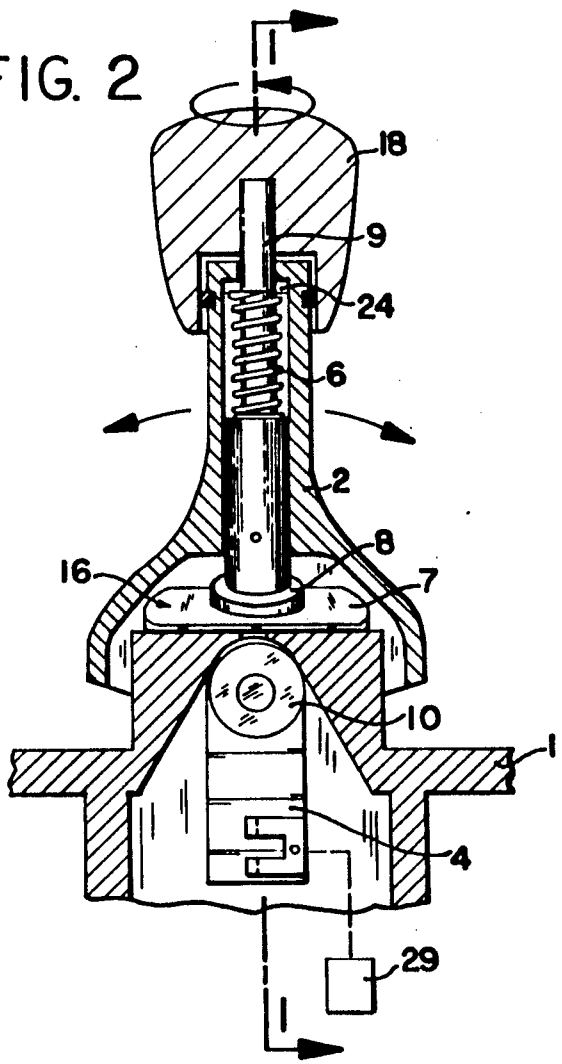
FIG. 2 is a section 2—2 taken in FIG. 1 of the setting apparatus.

The setting apparatus illustrated in FIG. 1 comprises a housing 1 and an operating grip 2. The operating grip 2, generally designated, comprises a shank 15 which diverges pot-shaped towards the housing 1 and is substantially shank-shaped in cross-section. The two arms 13, 14 of the Y are fixed to rotate with a shaft 10 by pins 11, 12 passed through the arms 13, 14 and the shaft 10. The shaft 10 is rotatably mounted in the housing 1. Fixed to rotate with the shaft there is a movable part 4 of a signal changing device, generally designated 29, for example a potentiometer, whilst another fixed part 5 of the signal changing device is connected to the housing 1.

The operating grip 2 forms a lever arm which extends from the shaft 10 up to the upper end thereof.

The shank 15 of the operating grip 2 comprises a through-going bore having a reduced diameter 27 at the upper end of the shank. In the bore, there is a pressure face body 20 carrying a pressure face member 8 at its lower end. The pressure face member 8, including its pressure face 8*a* (see FIG. 3*a*), is inclined at an angle to the longitudinal axis of the pressure body 20 and is fixed to rotate with the pressure body 20. The pressure body 20 is axially displaceable in the throughgoing bore of the shank 15. Axially displaceable together with the pressure body 20 but fixed against rotation by a pin 21 there is a rod 9 which projects upwardly from the operating grip 2 upper end. A pin 24 is passed through the rod 9 within the bore of the shank 15. The length of the pin is greater than the reduced diameter 27 at the upper end of the throughgoing bore. A spring 6 is supported on a flange 25 which forms the upper reduced diameter 27 of the bore 26. The other end of the spring 6 acts on the upper end of the pressure body 20. The pressure member is thereby permanently pressed towards the housing 1. Fixed to rotate with the upper end of the rod 9 that projects from the operating grip 2 there is a rotary knob 18. The rotary knob 18 is partly pushed over the operating grip 2. A seal 22 is disposed between the rotary knob 18 and the operating grip 2.

The housing 1 carries an abutment with an abutment body 7 housing an abutment face 16. The abutment body is triangular in cross-section. For this purpose, shaft 17 mounts the abutment apex portion. For this purpose, shaft 17 mounts the abutment body for rotation, the shaft being secured to the housing at one or more bearing points, not shown (the shaft being shown in FIG. 1 by dotted lines). Preferably, the abutment body is an equilateral triangle in cross-section. The angle of the tip apex portions not connected to the housing 1 corresponds to the difference between the angle of inclination of the pressure face relatively to the longitudinal axis of the operating grip and 90°.

If, now, the rotary knob 18 on the operating grip 2 is turned, the abutment 7 tilts (to the left in FIG. 1) and on the other hand the neutral position of the operating grip inclines out of the perpendicular. FIGS. 3*a* to 5*b* illustrate this condition. Suitable markings are provided on the shank of the operating grip and on the adjacent part of the knob, for example marking 19 on the shaft and marking 31 on the knob.

FIG. 3*a* illustrates the operating grip diagrammatically in a neutral position where the operating grip 2 is vertical. The angle of rotation of the rotary knob 18 is in this case 0°. The axis of the pressure body 20 always coincides with the axis of the operating grip 2.

In FIG. 3*a*, the operating grip therefore assumes a medium position between two extreme positions. The pressure member body 20 is turned so that the constant angle between the pressure member 20 and pressure face 8 lines in a plane perpendicular to the plane of movement. The abutment face 16 assumes the same angle in this plane in that the abutment body 7 tilts completely to the right. The angle between the longitudinal axis and the abutment face 16 in the plane of movement is 90°. This is clearly shown in FIG. 3*b*.

FIG. 4*a* shows a position in which the rotary knob 18 was turned through an angle between 0 and 90° . The constant angle between the pressure face member 8 and the longitudinal axis of the pressure body 20 is only partly projected into the plane perpendicular to the plane of movement of the operating grip 2. Another part of the angle is projected into the plane of movement of the operating grip 2, as is shown in FIG. 4*b*. The abutment body 7 is now tilted out of its right-hand end position towards the left and adapts to the angle of the pressure face member 8 in the plane perpendicular to the plane of movement.

FIGS. 5*a* and 5*b* show a position in which the pressure body 20 is turned through 90° relatively to the FIG. 3*a* position. Due to the fixed angle between the pressure member 8 and longitudinal axis of the pressure body 20, no part is now projected into the plane perpendicular to the plane of movement of the operating grip 2. The angle of inclination now lies fully within the plane of movement of the operating grip 2. This is shown in FIG. 5*b*. The operating grip remains in this position.

As will be evident from FIGS. 3*b*, 4*b* and 5*b*, the signal changing device 4, 5 has a different setting in every position of the pressure member body 20, i.e. in every neutral position of the operating grip 2. The operating grip 2 can be reciprocated out of this position in the plane of the drawing of FIGS. 3*b*, 4*b* and 5*b* but will return to its neutral position when no external force acts on it. Thus the rod 9, spring 6, pressure face member 8 and the abutment 16 forms centering mechanism for constantly urging the operating grip to its neutral position and selectively varying the neutral position.

Apart from the triangular cross-section for the abutment 7 as illustrated in FIGS. 3 to 5, the abutment body may also have a cross-section in the shape of the segment of a circle, as is shown in FIG. 6. The abutment body 107 is in this case mounted in a trough in the housing 101. When the abutment face 116 has to move to the left or right, the abutment body 107 is displaced in the trough as shown in broken lines. This has the advantage that the central point of the pressure face 8 will always have substantially the same vertical spacing from the housing 101.

I claim:

1. Setting apparatus comprising a housing, an elongated operating grip having a first end portion and a second end portion, a pivot member mounted by the grip operating second end portion and to the housing for mounting the operating grip for pivotal movement about a first axis between a neutral position and a second position, the operating grip having a longitudinal second axis, signal means for providing a signal when the operating grip is pivoted about the first axis, centering means for constantly urging the operating grip to its neutral position and selectively varying the neutral position, the centering means including a pressure face member on the operating grip, an abutment member, the pressure face member having a pressure face, connecting means for connecting the abutment member to the housing in abuttable relationship to the pressure face, the centerings means including a spring for exerting a resilient force along the longitudinal axis to resiliently retain the pressure face in abutting relationship to the abutment member, the pressure member and the abutment member being adjustable relative to the respective one of the housing and operating grip on which the operating grip and the housing are provided for selectively varying the relative position of the pressure face to the abutment member and thereby the neutral position of the operating grip.

2. The setting apparatus of claim 1, comprising that the centering means includes a rod rotatably mounted by the operating grip and having a third axis that defines the axis of rotation of the rod, the third axis being coextensive with the second axis, the pressure member being fixed to the rod to rotate therewith.

3. The setting apparatus of claim 1, comprising that the centering means includes a rotatable rod mounted by the operating grip first end portion for limited axial movement relative thereto, the pressure face member being mounted by the rod for axial movement therewith in fixed rotatable relationship thereto.

4. The setting apparatus of claim 1, comprising that the pivot member is fixed to the operating grip to pivot therewith, and that the signal means includes a first part fixed to the pivot member to pivot therewith and a second part mounted by the housing.

5. The setting apparatus of claim 1, comprising that the abutment member comprises an abutment body having an abutment face that is in abutable relationship to the pressure face and that the connecting means comprises means for mounting the abutment body on the housing for pivotal movement about an axis extending perpendicular to the first axis.

6. The setting apparatus of claim 1, comprising that the pivot member has a pivot axis and that the operating grip end portion has a first and a second bifurcated leg mounted on the pivoted member and that the pressure face member and abutment member are disposed between planes extending through the bifurcated legs and perpendicular to the pivot member axis.

7. Setting apparatus according to claim 1, characterized in that the abutment member in cross section in a plane containing the longitudinal axis is that of a segment of a circle and that the housing has a trough in which the abutment member is pivotally mounted.

8. The setting apparatus of claim 1, comprising that the abutment member in cross section in a plane containing the longitudinal axis is triangular.

9. The setting apparatus of claim 1, comprising that the pressure face is inclined relative to the longitudinal axis of the operating grip and is adjustable in a plane of movement of the operating grip, the longitudinal axis being perpendicular to the first axis.

10. The setting apparatus of claim 9, comprising that the centering means includes a rod mounted by the operating grip first end portion for limited movement along the longitudinal axis, the rod having a first end portion connected to the pressure face member, and that the spring is disposed in the operating grip and acting against one of the rod and pressure face member for constantly resiliently urging the respective one of the rod and pressure face member to resiliently retain the pressure face in abutting relationship to the abutment member, the pressure face being disposed to face the housing.

11. The setting apparatus of claim 10, comprising that the spring is a coiled spring and that the rod extends through the spring.

12. The setting apparatus of claim 1, comprising that the centering means includes a rod mounted by the operating grip first end portion for rotary movement about the longitudinal axis, the rod having a first end portion connected to the pressure face member to rotate the pressure face member therewith and a second end portion that projects outward of the operating grip, and a knob connected to the rod second end portion for selectively rotating the rod.

13. The setting apparatus of claim 12 comprising that the pressure face is inclined relative to the longitudinal axis and the rod and pressure face member are mounted for limited movement in the direction of longitudinal axis, that the spring acts between one of the operating grip and the rod for resiliently retaining the pressure face in abutting relationship to the abutment member and that the connecting means mounts the abutment member for pivotal movement about an axis contained in a plane that extends perpendicular to the first axis.

14. The setting apparatus of claim 13 comprising that the abutment member has an abutment face facing toward the pressure face, the spring acting between the rod and the operating grip to resiliently retain the pressure face in abutting relationship to the abutment face, the knob and pressure member being fixed to the rod so that the pressure member is rotated relative to the abutment member when the knob is rotated relative to the operating grips and moves both rotatably and longitudinally with the rod.

15. Setting apparatus comprising a housing, an elongated operating grip having a first end portion and a second end portion, a pivot member mounted by the housing for mounting the operating grip for pivotal movement about a first axis between a neutral position and a second position, the operating grip having a longitudinal axis, signal means for providing a signal when the operating grip is pivoted about the first axis, centering means for constantly urging the operating grip to its neutral position, the centering means including a pressure face member mounted on the operating grip for movement therewith and relative thereto, the pressure face member having a pressure face, an abutment member having a face, connecting means for connecting the abutment member to the housing for pivotal movement with the abutment member face in abutable relationship to the pressure face, the centering means including a spring for exerting a resilient force along the longitudinal axis to resilient retain the pressure face in abutting relationship to the abutment member face, and means for rotating the pressure face member relative to the operating grip and the abutment member to vary the pivotal relationship of the abutment member face relative to the housing to selectively vary the neutral position, the pivotal axis of the connecting means being in a plane perpendicular to the axis of the pivotal movement of the operating grip relative to the housing, the pressure face being inclined relative to the longitudinal axis, and the signal means including a first part mounted by the pivot member for movement therewith and a second part fixed to the housing.

16. Setting apparatus comprising a housing, an elongated operating grip having a first end portion and a second end portion, a pivot member mounted by the grip operating second end portion and to the housing for mounting the operating grip for pivotal movement about a first axis between a neutral position and a second position, the operating grip having a longitudinal second axis, signal means for providing a signal when the operating grip is pivoted about the first axis, centering means for constantly urging the operating grip to its neutral position and selectively varying the neutral position, the centering means including a pressure face member on the operating grip and having a pressure face, an abutment member, connecting means for connecting the abutment member to the operating grip in abuttable relationship to the pressure face, the centering means including a spring for exerting a resilient force along the longitudinal axis to resiliently retain the pressure face in abutting relationship to the abutment member, at least one of the pressure member and the abutment member being adjustable relative to the respective one of the housing and operating grip on which the abutment member and the housing are provided for selectively varying the relative position of the pressure face to the abutment member and thereby the neutral position of the operating grip, the centering means including a rod mounted by the operating grip first end portion for rotary movement about the longitudinal axis, the rod having a first end portion connected to the pressure face member to rotate the pressure face member therewith and a second end portion that projects outward of the operating grip, and a knob connected to the rod second end portion in a fixed longitudinal and angular position relative to the rod second end portion for selectively rotating the rod.

* * * * *